US010766063B2

(12) United States Patent
Kurosawa et al.

(10) Patent No.: US 10,766,063 B2
(45) Date of Patent: Sep. 8, 2020

(54) EVAPORATIVE PATTERN CASTING METHOD

(71) Applicant: KOBE STEEL, LTD., Hyogo (JP)

(72) Inventors: Eisuke Kurosawa, Hyogo (JP); Kazuyuki Tsutsumi, Hyogo (JP)

(73) Assignee: KOBE STEEL, LTD., Hyogo (JP)

( * ) Notice: Subject to any disclaimer, the term of this patent is extended or adjusted under 35 U.S.C. 154(b) by 159 days.

(21) Appl. No.: 16/074,203

(22) PCT Filed: Jan. 26, 2017

(86) PCT No.: PCT/JP2017/002751
§ 371 (c)(1),
(2) Date: Jul. 31, 2018

(87) PCT Pub. No.: WO2017/135150
PCT Pub. Date: Aug. 10, 2017

(65) Prior Publication Data

US 2019/0388962 A1 Dec. 26, 2019

(30) Foreign Application Priority Data

Feb. 2, 2016 (JP) ..... 2016-017657
Mar. 23, 2016 (JP) ..... 2016-058743

(51) Int. Cl.
*B22C 9/04* (2006.01)
*B22C 7/02* (2006.01)

(52) U.S. Cl.
CPC ..... *B22C 9/046* (2013.01); *B22C 7/023* (2013.01)

(58) Field of Classification Search
CPC ..... B22C 9/04; B22C 9/043; B22C 9/046; B22C 7/00; B22C 7/02; B22C 7/023
See application file for complete search history.

(56) References Cited

FOREIGN PATENT DOCUMENTS

| | | | |
|---|---|---|---|
| CN | 102873262 | A | 1/2013 |
| CN | 104550677 | A | 4/2015 |
| JP | 2003-290869 | A | 10/2003 |

(Continued)

OTHER PUBLICATIONS

International Search Report; issued in PCT/JP2017/002751; dated May 9, 2017.

(Continued)

*Primary Examiner* — Kevin P Kerns
*Assistant Examiner* — Steven S Ha
(74) *Attorney, Agent, or Firm* — Studebaker & Brackett PC

(57) ABSTRACT

A mold wash is used in a casting method using a lost foam to make a casting having a hole with a diameter of 12 mm or less. The casting method includes determining a thermal decomposition amount $\Delta C(\theta,t)$ [wt %] of a resin binder when the mold wash is exposed at a temperature $\theta$ [° C.] for a time t [sec], and determining a room temperature transverse rupture strength $\sigma_b(\theta,t)$ [MPa] of the mold wash after receiving thermal loads, and performing casting with the mold wash having the room temperature transverse rupture strength $\sigma_b(\theta,t)$ after receiving thermal loads being equal to or larger than a threshold value $\sigma_{cr}$ [MPa].

6 Claims, 10 Drawing Sheets

(56) References Cited

FOREIGN PATENT DOCUMENTS

| | | | |
|---|---|---|---|
| JP | 3983583 | B2 | 9/2007 |
| JP | 2010-142867 | A | 7/2010 |
| JP | 2010-274314 | A | 12/2010 |
| KR | 970003118 | B1 | 3/1997 |
| TW | 344687 | B | 11/1998 |

OTHER PUBLICATIONS

Basics of Foundry Technology, PowerPoint presentation of the Registered Association of German Foundrymen (e.V.) VDG, 2005, downloaded from:https://www.vdg.de/fileadmin/content/03_documents/Grundlagen_der_Giessereitechnik_1.pdf.

EVAPORATIVE PATTERN CASTING METHOD

TECHNICAL FIELD

The present invention relates to a casting method using a lost foam for making a casting including a hole.

BACKGROUND ART

The casting method using a lost foam is a method in which a casting pattern obtained by applying a mold wash to the surface of a foam pattern is embedded in foundry sand, and a molten metal is then poured into the casting pattern, thereby losing the foam pattern and replacing the foam pattern with the molten metal, thereby making a casting. It may be considered that this casting method using a lost foam is most suitable for forming a hole (referred to as a "cast hole") in the casting by performing casting.

In the casting method using a lost foam, during casting, large thermal loads from the surroundings act on the mold wash applied to the surface of the hole of the foam pattern (a portion where the hole is formed by casting) and on the foundry sand packed in the hole. In addition, various external forces (e.g., a molten metal hydrostatic pressure, a dynamic pressure by molten metal flow, etc.) act thereon from the molten metal.

In the case where the mold wash itself does not withstand the above-described thermal loads or external forces, a casting defect called "seizure" in which the mold wash is damaged and the molten metal seeps into the foundry sand packed in the hole and fuses with the foundry sand may occur. In particular, when it is contemplated to form a small hole with a diameter of 12 mm or less by casting, the frequency of generation of seizure due to the damage of the mold wash becomes high, so that it becomes difficult to form a small hole with a good finish.

Then, Patent Literature 1 discloses a mold wash composition for lost foam in which a chromaticity of the L*a*b* colorimetric system and a measured value by a Brookfield viscometer are set to the appropriate ranges. According to this, a coating film with a uniform thickness is obtained, and therefore, metal penetration generated in the case where the coating film is thin is avoided.

In addition, Patent Literature 2 discloses a mold wash composition for lost foam in which a composition is set to an appropriate range. According to this, metal penetration defects and transfer of a drooped line can be prevented from occurring.

In addition, Patent Literature 3 discloses a mold wash composition for lost foam containing an ore whose endothermic peak temperature (° C.) by differential thermal analysis falls within a specified range. According to this, the generation of residue defects and metal penetration defects can be prevented from occurring.

CITATION LIST

Patent Literature

Patent Literature 1: JP 2010-274314 A
Patent Literature 2: JP 2010-142867 A
Patent Literature 3: JP 2003-290869 A

SUMMARY OF INVENTION

Technical Problems

However, in the Patent Literatures 1 to 3, the size of the cast hole part is as large as 60×100 mm in cross section and 110 mm in length. For that reason, even in the case of forming a small hole with a diameter of 12 mm or less by casting, it cannot be said that the seizure can be prevented from occurring by the methods disclosed in these Patent Literatures.

Typically, in many cases, a small hole with a diameter of 12 mm or less is formed by machining after casting is formed without forming a cast hole. But, such a case leads to an increase in machining costs.

Then, there is a case where a material of the mold wash and casting conditions are determined by producing several trial samples, thereby realizing a small cast hole. However, in the actual condition, with this method, it is difficult to produce castings in a stable manner. In addition, even if castings could have been produced in a stable manner, a lot of costs and times of production of trial samples would be required. Therefore, it is important to make selection guidelines of a mold wash suited for making a small cast hole clear beforehand.

An object of the present invention is to provide a casting method using a lost foam capable of forming a highly-finished small hole with a diameter of 12 mm or less by casting.

Solution to Problems

The present invention provides a casting method using a lost foam, comprising embedding, in foundry sand, a casting pattern formed by applying a mold wash to a surface of a foam pattern; and pouring a molten metal into the casting pattern and losing the foam pattern to replace the foam pattern with the molten metal, thereby making a casting with a thickness T [mm], the casting including a hole with a diameter of 12 mm or less and a length l [mm], the casting method comprising the steps of:

determining a thermal decomposition amount $\Delta C(\theta,t)$ [wt %] of a resin binder when the mold wash is exposed at a temperature $\theta$ [° C.] for a time t [sec], from the following formulae (1) to (3), wherein $\Delta C_{sat}(\theta)$ [wt %] is a critical thermal decomposition amount of the resin binder contained in the mold wash at a temperature $\theta$ [° C.], $k_d$ [1/sec] is a thermal decomposition rate constant of the resin binder, $\theta_s$ [° C.] is a temperature at which thermal decomposition of the resin binder starts, and A, $\alpha$, and $\beta$ are material parameters relying on a material of the mold wash, respectively;

determining a room temperature transverse rupture strength $\sigma_b(\theta,t)$ [MPa] of the mold wash after receiving thermal loads from the following formula (4), wherein $\sigma_{c0}$ [MPa] is a room temperature transverse rupture strength of the mold wash before receiving thermal loads, $\sigma_{c1}$ [MPa] is a room temperature transverse rupture strength of the mold wash after the resin binder is completely thermally decomposed, $\sigma_s(\theta,t)$ [MPa] is a strength increase caused by reaction and sintering among aggregates contained in the mold wash, and $\gamma$ is a material parameter relying on the material of the mold wash; and performing casting with the mold wash having the room temperature transverse rupture strength $\sigma_b(\theta,t)$ after receiving thermal loads being equal to or larger than a threshold value $\sigma_{cr}$ [MPa]:

$$\Delta C(\theta,t)=\Delta C_{sat}(\theta)\cdot\{1-\exp(-k_d t)\} \quad (1)$$

$$\Delta C_{sat}(\theta)=\tanh\{\beta(\theta-\theta_s)\}\times 100 \quad (2)$$

$$k_d=A\exp(\alpha\theta) \quad (3)$$

$$\sigma_b(\theta,t)=\sigma_{c0}-(\sigma_{c0}-\sigma_{c1})\tanh(\gamma\Delta C(\theta,t))+\sigma_s(\theta,t) \quad (4).$$

Advantageous Effects of Invention

In the present invention, for making a casting with a thickness T [mm], the casting including a hole with a diameter of 12 mm or less and a length l [mm], the thermal decomposition amount and thermal decomposition rate of the resin binder contained in the mold wash can be estimated by adopting the formulae (1) to (3). A change of the room temperature transverse rupture strength $\sigma_b(\theta,t)$ relying on the thermal decomposition amount $\Delta C(\theta,t)$ of the resin binder can be estimated by adopting the formula (4). From these estimation results, a mold wash which is less in a lowering of the strength caused by the thermal loads and which is suitable for casting a small hole can be selected. Specifically, the thermal decomposition amount $\Delta C(\theta,t)$ [wt %] of the resin binder when the mold wash is exposed at the temperature θ [° C.] for the time t [sec] is determined from the formulae (1) to (3). Then, the determined thermal decomposition amount $\Delta C(\theta,t)$ is substituted into the formula (4), thereby determining the room temperature transverse rupture strength $\sigma_b(\theta,t)$ [MPa] of the mold wash after receiving the thermal loads. Then, the casting is performed with the mold wash having the determined room temperature transverse rupture strength $\sigma_b(\theta,t)$ being equal to or larger than the threshold value $\sigma_{cr}$ [MPa]. Thanks to this, since the strength of the mold wash can be made to exceed the external forces from the molten metal, the mold wash can be prevented from being damaged. Accordingly, even a highly-finished small hole with a diameter of 12 mm or less can be formed by casting.

DESCRIPTION OF EMBODIMENTS

Preferred embodiments of the present invention are hereunder described with reference to the accompanying drawings.

(Casting Method Using Lost Foam)

The casting method using a lost foam of the present embodiment is a method including embedding, in foundry sand (dry sand), a casting pattern formed by applying a mold wash to the surface of a foam pattern, and pouring a molten metal into the casting pattern and losing the foam pattern to replace the foam pattern with the molten metal, thereby making a casting with a thickness T [mm], the casting including a hole with a diameter of 12 mm or less and a length l [mm]. It may be considered that this casting method using a lost foam is most suitable for, for example, making a casting with a thickness of 25 mm or less, the casting including a hole with a diameter of 12 mm or less and a length of 100 mm or less by "cast hole"

The casting method using a lost foam includes: a melting step of melting a metal (cast iron) to produce a molten metal; a forming step of forming a foam pattern; and an applying step of applying a mold wash to the surface of the foam pattern to obtain a casting pattern. Furthermore, the casting method using a lost foam includes a molding step of embedding a casting pattern in foundry sand to pack the foundry sand in every corner of the casting pattern; a casting step of pouring a molten metal into the casting pattern to melt the foam pattern, thereby replacing the foam pattern with the molten metal; a cooling step of cooling the molten metal having been poured into the casting pattern to produce a casting; and a separating step of separating the casting and the foundry sand from each other.

As the metal for producing the molten metal, gray cast iron (JIS-FC250), spherical graphite cast iron (JIS-FCD450), and the like can be used. As the foam pattern, a foamed resin such as a polystyrene foam can be used. As the mold wash, a mold wash of a silica-based aggregate, and the like can be used. As the foundry sand, "silica sand" including $SiO_2$ as a main component, zircon sand, chromite sand, synthetic ceramic sand, and the like can be used. A binder or a curing agent may be added to the foundry sand.

In the present embodiment, the mold wash is twice applied to the foam pattern (dual coating). A thickness of the mold wash is preferably 3 mm or less. This is because when the thickness of the mold wash is 3 mm or more, it is needed to repeat the application and drying of the mold wash at least 3 times, so that not only a lot of time is required, but also the thickness is liable to become non-uniform.

Figure 1A:
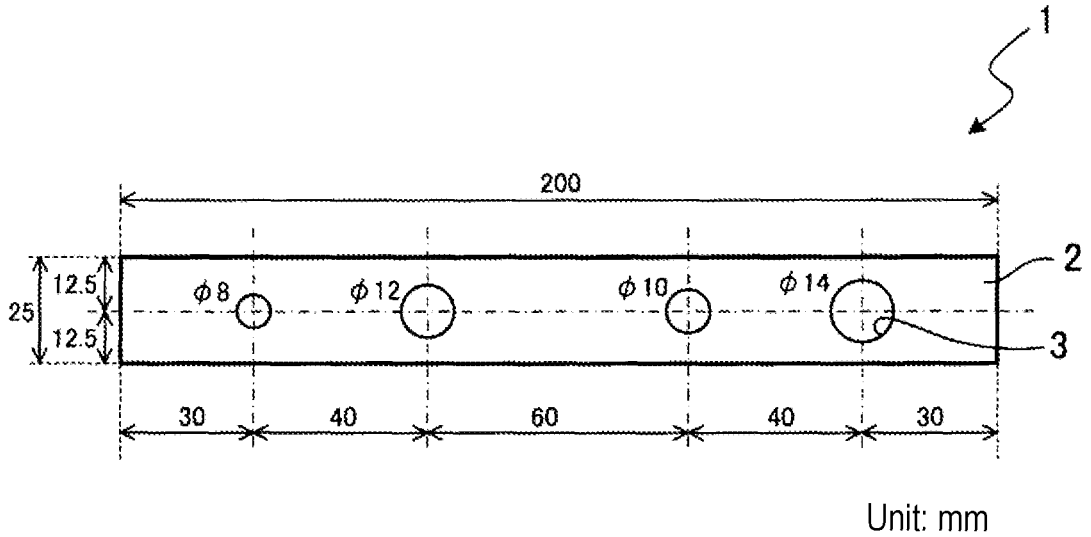
FIG. 1A is a top view of a casting pattern.
Figure 1B:
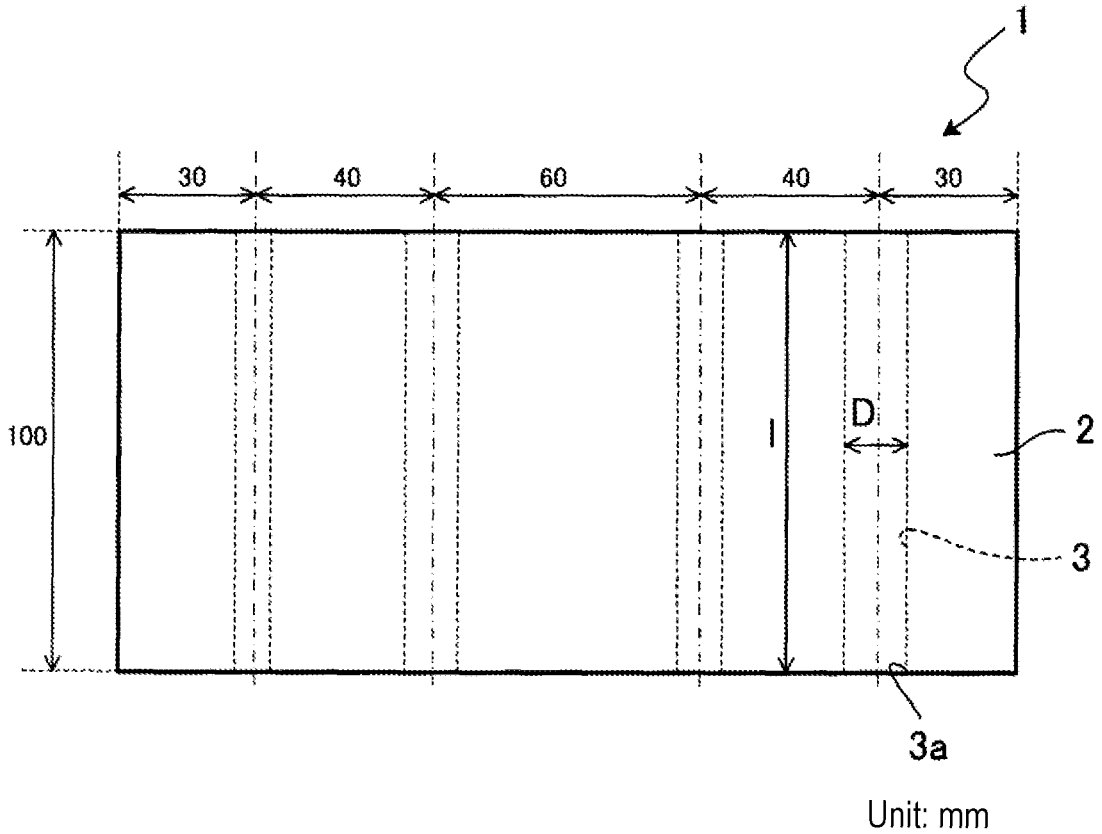
FIG. 1B is a side view of a casting pattern.

Here, as illustrated in FIG. 1A that is a top view and FIG. 1B that is a side view, the following case is considered: a casting with a thickness T [mm] and including a hole with a diameter of 12 mm or less and a length l [mm] is made by using a casting pattern 1 in which a hole 3 (a portion where the hole is formed by casting) with a diameter D [mm] and a length l [mm] is provided extending from the upper surface to the lower surface in a foam pattern 2 having a rectangular parallelepiped shape. The hole 3 is provided in such a manner that an edge is formed in a space against the surface of the foam pattern 2 in a hole end 3*a*. That is, the hole end 3*a* is not subjected to machining such as tapering. The diameter D of the hole 3 is a length between the surfaces of the hole 3 across a center line of the hole 3 but not a length between the surfaces of the mold wash applied to the surface of the hole 3.

The mold wash contains an aggregate of refractory and a resin binder for forming a film. During casting, when the mold wash is exposed to the molten metal, the thermal decomposition of the resin binder proceeds, and the strength of the mold wash itself is lowered. When the thermal decomposition of the resin binder is completed, the film formed of the mold wash becomes in a state of being supported only by a binding power among the aggregates and becomes in a state of not substantially having strength.

In the present embodiment, first of all, the thermal decomposition amount $\Delta C(\theta,t)$ [wt %] of the resin binder when the mold wash is exposed at the temperature θ [° C.] for the time t [sec] is determined from the following formulae (1) to (3).

$$\Delta C(\theta,t)=\Delta C_{sat}(\theta)\cdot\{1-\exp(-k_d t)\} \quad (1)$$

$$\Delta C_{sat}(\theta)=\tanh\{\beta(\theta-\theta_s)\}\times 100 \quad (2)$$

$$k_d=A\exp(\alpha\theta) \quad (3)$$

Here, $\Delta C_{sat}(\theta)$[wt %] is a critical thermal decomposition amount of the resin binder at the temperature θ [° C.]. $k_d$ [1/sec] is a thermal decomposition rate constant of the resin binder. $\theta_s$ [° C.] is a temperature at which the thermal decomposition of the resin binder starts. A, α, and β are each a material parameter relying on the material of the mold wash.

Next, the room temperature transverse rupture strength $\sigma_b(\theta,t)$ [MPa] of the mold wash after receiving the thermal loads is determined using the determined thermal decomposition amount $\Delta C(\theta,t)$ based on the following formula (4).

$$\sigma_b(\theta,t)=\sigma_{c0}-(\sigma_{c0}-\sigma_{c1})\tanh(\gamma\Delta C(\theta,t))+\sigma_s(\theta,t) \quad (4)$$

Here, $\sigma_{c0}$ [MPa] is a room temperature transverse rupture strength of the mold wash before receiving thermal loads (in a dry state). $\sigma_{c1}$ [MPa] is a room temperature transverse rupture strength of the mold wash after the resin binder is completely thermally decomposed. $\sigma_s(\theta,t)$ [MPa] is a strength increase caused by reaction and sintering among the aggregates contained in the mold wash. γ is a material parameter relying on the material of the mold wash.

Then, the casting is performed with the mold wash having the determined room temperature transverse rupture strength $\sigma_b(\theta,t)$ being equal to or larger than a threshold value $\sigma_{cr}$ [MPa].

(Thermal Decomposition Amount of Resin Binder)

Here, when the thermal decomposition of the resin binder is approximated as a first order reaction, the relationship of the following formula (5) is held.

$$In(C_0/C_t)=k_d t \quad (5)$$

Here, $C_0$ [wt %] is an initial concentration of the resin binder contained in the mold wash, and $C_t$ [wt %] is a concentration of the resin binder after the mold wash is exposed at the temperature θ [° C.] for the time t [sec]. In addition, t is a time for which the mold wash is exposed at the temperature θ.

When the thermal decomposition amount of the resin binder when the mold wash is exposed at the temperature θ [° C.] for the time t [sec] is defined as $\Delta C(\theta,t)$ [wt %], the formula (5) can be changed to the following formula (6).

$$\Delta C(\theta,t)=f(\theta)\cdot(1-C_t/C_0)=f(\theta)\cdot\{1-\exp(-k_d t)\} \quad (6)$$

Here, f(θ) represents a function of the temperature θ.

It may be considered that in the vicinity of the temperature $\theta_s$ at which the thermal decomposition of the resin binder starts, even when a long time is taken, there is a limit in the amount of resin at which the decomposition can be performed. For that reason, the amount of resin at which the decomposition can be achieved at a certain temperature θ is expressed by the thermal decomposition amount $\Delta C(\theta,t)$ at the time of $t\rightarrow\infty$ in the formula (6). In consequence, when the critical thermal decomposition amount of the resin binder at the temperature θ [° C.] is defined as $\Delta C_{sat}(\theta)$ [wt %], the formula (6) can be rewritten as the following formula (1).

$$\Delta C(\theta,t)=\Delta C_{sat}(\theta)\cdot\{1-\exp(-k_d t)\} \quad (1)$$

(Thermal Decomposition Rate of Resin Binder)

The thermal decomposition rate of the resin binder varies with the temperature θ. That is, it may be considered that the higher the temperature is, the faster the progress of the thermal decomposition is. Then, it is necessary to take into consideration the temperature dependency of the thermal decomposition rate constant $k_d$ of the resin binder. The above-described temperature dependency can be expressed by the Arrhenius equation represented by the following formula (7).

$$k_d=f\exp(-\Delta E/R\theta) \quad (7)$$

Here, f is a development factor; ΔE is an activation energy [J/mol]; and R is a gas constant [J/mol/K].

For simplification, the formula (7) is rewritten as the following formula (3).

$$k_d=A\exp(\alpha\theta)$$

$$\alpha=R/\Delta E \quad (3)$$

From the formula (3), it becomes possible to determine the thermal decomposition rate constant $k_d$ at an arbitrary temperature θ.

From the foregoing, the thermal decomposition amount $\Delta C(\theta,t)$ of the resin binder when the mold wash is exposed at the temperature θ [° C.] for the time t [sec] can be determined from the combination of the formula (1) with the formula (3). Since $\Delta C_{sat}(\theta)$, A, and α rely on the material of the mold wash (resin binder used), they can be identified through a simple experiment, such as a heat exposure test using various mold washes.

With respect to the critical thermal decomposition amount $\Delta C_{sat}(\theta)$ of the resin binder, taking into consideration the matters that when heated at a temperature equal to or higher than the temperature θs at which the thermal decomposition of the resin binder starts, the thermal decomposition abruptly increases and that when heated at a certain temperature or higher for a long time, the resin binder is completely thermally decomposed (the thermal decomposition amount is 100%), simulation can be made as in the following formula (2).

$$\Delta C_{sat}(\theta)=\tanh\{\beta(\theta-\theta_s)\}\times 100 \quad (2)$$

Here, β is a material parameter indicating the easiness of thermal decomposition.

So long as β can be identified through an experiment using various mold washes (resin binders), it becomes possible to determine the critical thermal decomposition amount $\Delta C_{sat}(\theta)$.

(Strength of Mold Wash)

The strength of the mold wash can be evaluated in terms of a transverse rupture strength (bending strength). However, since it is extremely difficult to directly measure the high-temperature strength of the mold wash, a strength decrease of the mold wash, caused by the thermal decomposition of the resin binder is evaluated by measuring the transverse rupture strength of the mold wash on the occasion of applying thermal loads to thermally decompose the resin binder and then returning the temperature to room temperature.

The room temperature transverse rupture strength $\sigma_b(\theta,t)$ of the mold wash after receiving the thermal loads is considered while dividing into a strength by a binding power among the aggregates contained in the mold wash and a strength increase $\sigma_s(\theta,t)$ caused by reaction and sintering among the aggregates. The room temperature transverse rupture strength $\sigma_b(\theta,t)$ of the mold wash after receiving the thermal loads can be expressed as shown in the following formula (8).

$$\sigma_b(\theta,t)=\sigma_{c0}-\sigma_t(\Delta C(\theta,t))+\sigma_s(\theta,t) \quad (8)$$

Here, $\sigma_{c0}$ [MPa] is a room temperature transverse rupture strength of the mold wash before receiving thermal loads. $\sigma_t(\Delta C(\theta,t)$ [MPa] is a strength decrease of the mold wash caused by the thermal decomposition of the resin binder. $\sigma_s(\theta,t)$ [MPa] is a strength increase caused by reaction and sintering among the aggregates contained in the mold wash.

When the room temperature transverse rupture strength (strength only by a binding power among the aggregates) of the mold wash after the resin binder is completely thermally decomposed is defined as $\sigma_{c1}$ [MPa], the formula (8) can be rewritten as the following formula (9).

$$\sigma_b(\theta,t)=\sigma_{c0}-\sigma_t(\Delta C(\theta,t))+\sigma_s(\theta,t) \quad (9)$$

Here, $\sigma_{c0}(\Delta C)$ represents a function of the thermal decomposition amount ΔC of the resin binder.

As a result of performing the room temperature transverse rupture strength test while changing the thermal decomposition amount ΔC of the resin binder for various mold washes, it has been found that the formula (9) can be approximated by a hyperbolic function as in the following formula (4).

$$\sigma_b(\theta,t)=\sigma_{c0}-(\sigma_{c0}-\sigma_{c1})\tanh(\gamma\Delta C(\theta,t))+\sigma_s(\theta,t) \quad (4)$$

Here, γ is a material parameter relying on the material of the mold wash (resin binder) and is identified through an experiment.

By substituting the thermal decomposition amount ΔC(θ, t) [wt %] determined based on the formula (1) into the formula (4), it becomes possible to determine the room temperature transverse rupture strength $\sigma_b$ (θ,t) [MPa] of the mold wash after receiving the thermal loads.

(Selection Guidelines of Mold Wash)

In the casting method using a lost foam, thermal loads from the surroundings act on the mold wash applied to the surface of the hole 3 of the foam pattern 2 and on the foundry sand packed in the hole 3. In addition, various external forces (e.g., a molten metal hydrostatic pressure, a dynamic pressure by molten metal flow, etc.) act thereon from the molten metal. When the strength of the mold wash having received thermal loads exceeds the above-described external forces, a small hole can be formed by casting without damaging the mold wash.

When the mold wash itself receives thermal loads, the strength tends to be lowered. Therefore, it is necessary to inhibit this lowering of the strength. Then, it is necessary to select a mold wash which is less in a lowering of strength caused by thermal loads, and selection guidelines thereof may be considered as follows.

(a) To select a mold wash using a resin binder in which the progress of the thermal decomposition is slow.

(b) To select a mold wash in which even when the thermal decomposition of the resin binder proceeds, the lowering of strength is small.

(c) To select a mold wash containing aggregates which make it possible to generate a product capable of revealing the strength through reaction and sintering.

A thermal decomposition behavior (thermal decomposition amount and thermal decomposition rate) of the resin binder contained in the mold wash can be estimated beforehand by adopting the formulae (1) to (3). In addition, a tendency in change of the room temperature transverse rupture strength relying on the thermal decomposition amount of the resin binder can be estimated beforehand by adopting the formula (4). From these results, a mold wash which is less in a lowering of the strength caused by the thermal loads and which is suitable for forming a small hole by casting can be selected on the basis of the above-described selection guidelines.

Then, in the present embodiment, the casting is performed with a mold wash having the room temperature transverse rupture strength $\sigma_b$ (θ,t) [MPa] of the mold wash after receiving thermal loads, as calculated according to the foregoing formula (4), being equal to or larger than the threshold value $\sigma_{cr}$ [MPa]. Thanks to this, since the strength of the mold wash can be made to exceed the external forces from the molten metal, the mold wash can be prevented from being damaged. Accordingly, even a highly-finished small hole with a diameter of 12 mm or less can be formed by casting.

By performing the casting with a mold wash in which the threshold value $\sigma_{cr}$ is set to 0.56 MPa, and the room temperature transverse rupture strength $\sigma_b(\theta,t)$ after receiving thermal loads is 0.56 MPa or more, the strength of the mold wash can be suitably made to exceed the external forces from the molten metal.

As described later, when the thermal decomposition amount ΔC(θ,t) of the resin binder is 83 wt % or more, a strength increase caused by reaction and sintering among the aggregates is revealed. At this time, by performing the casting with the mold wash having the room temperature transverse rupture strength $\sigma_b(\theta,t)$ after receiving thermal loads being 0.56 MPa or more, the strength of the mold wash can be suitably made to exceed the external forces from the molten metal.

On the occasion of making a casting with a thickness T of 25 mm or less, the casting including a hole with a diameter of 8 mm or more and a length l of 100 mm or less, the mold wash is twice applied to the foam pattern. Thanks to this, the thickness of the mold wash can be made uniform, and therefore, the mold wash can be made to be hardly damaged.

(Estimation of Thermal Decomposition Amount and Thermal Decomposition Rate of Resin Binder)

Next, various mold washes were evaluated. Four kinds of mold washes are shown in Table 1.

TABLE 1

| Mold wash | Aggregates |
|---|---|
| A | $SiO_2$ base |
| B | $SiO_2$ base |
| C | $Al_2O_3$—$SiO_2$ base |
| D | $Al_2O_3$—$SiO_2$ base |

Figure 2:
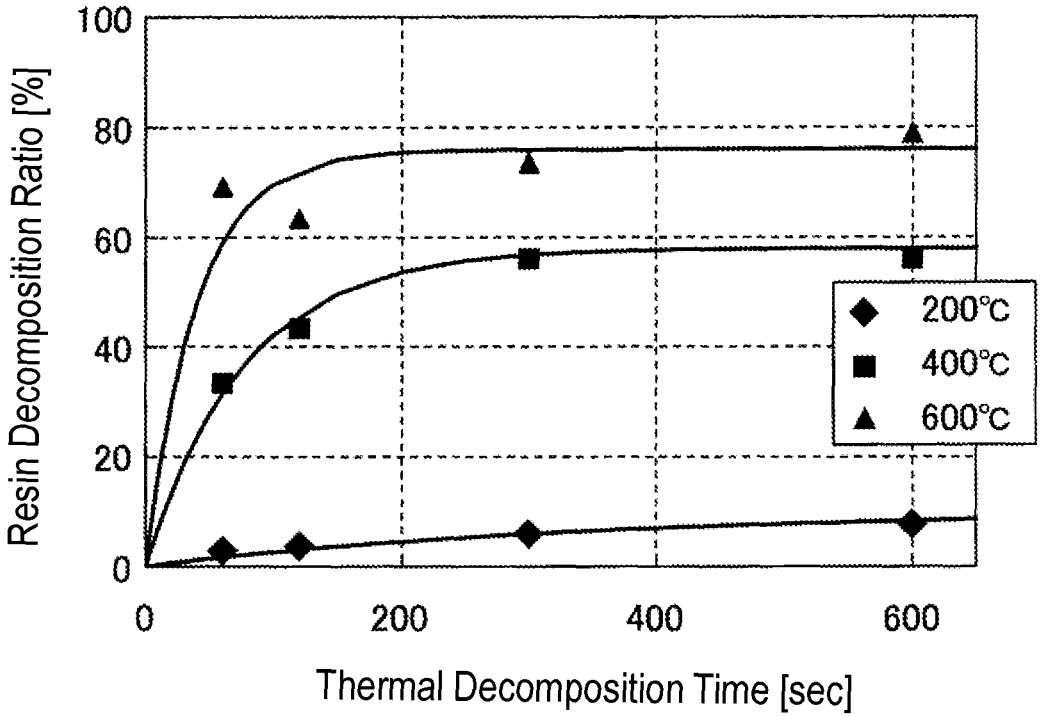
FIG. 2 is a graph showing the relationship between a resin decomposition ratio and a thermal deposition time in a mold wash A.
Figure 3:
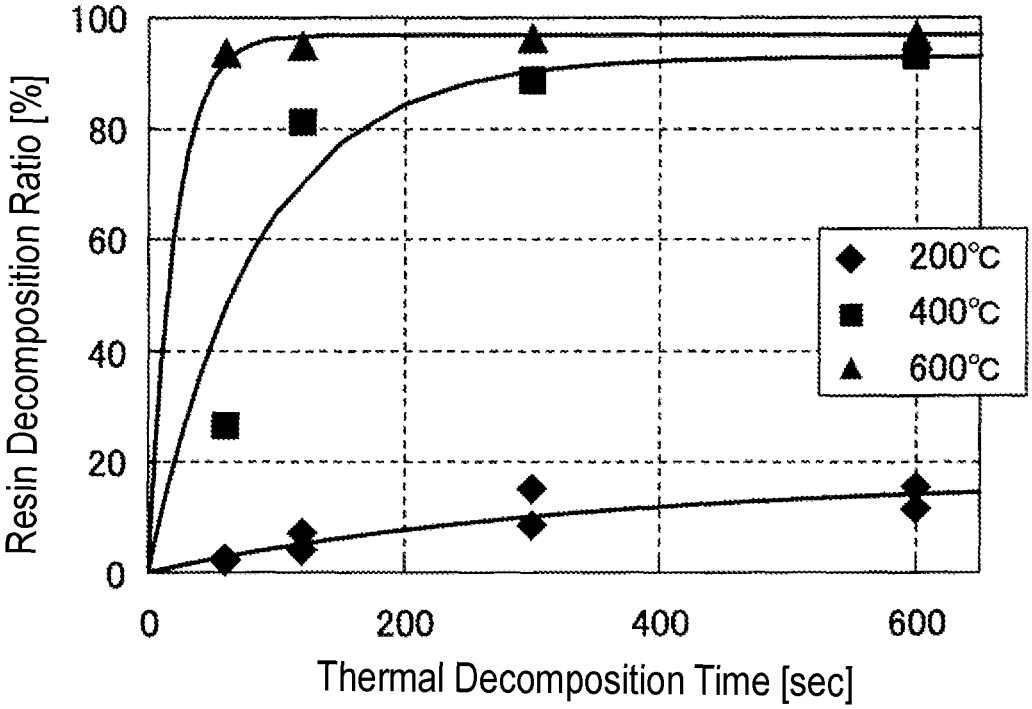
FIG. 3 is a graph showing the relationship between a resin decomposition ratio and a thermal deposition time in mold wash B.
Figure 4:
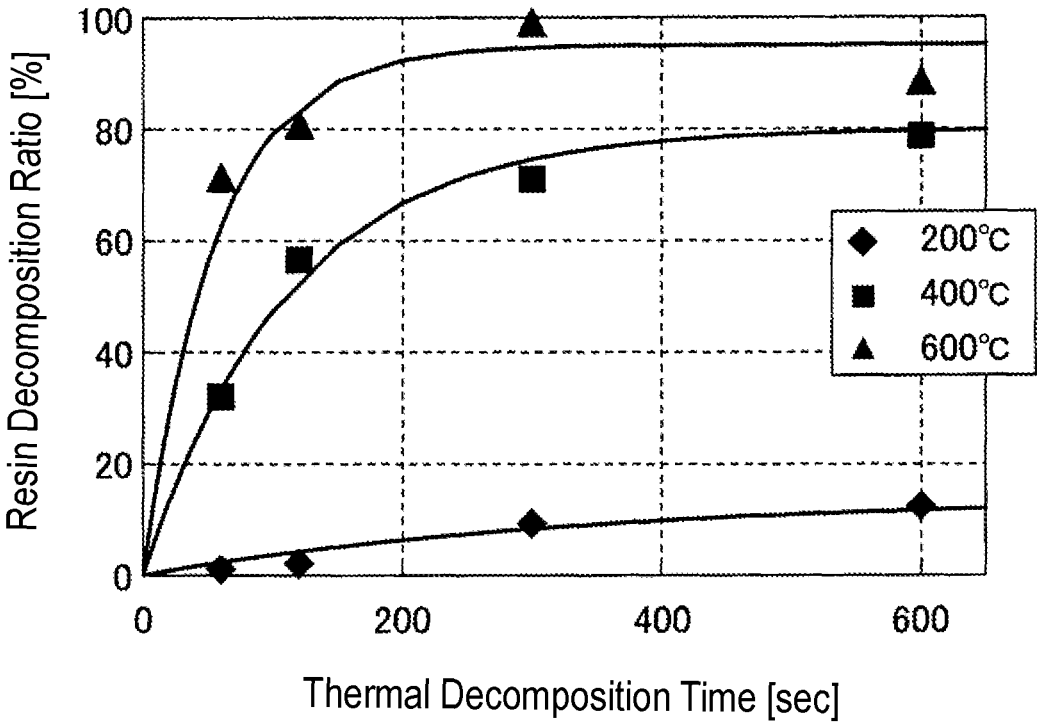
FIG. 4 is a graph showing the relationship between a resin decomposition ratio and a thermal deposition time in a mold wash C.
Figure 5:
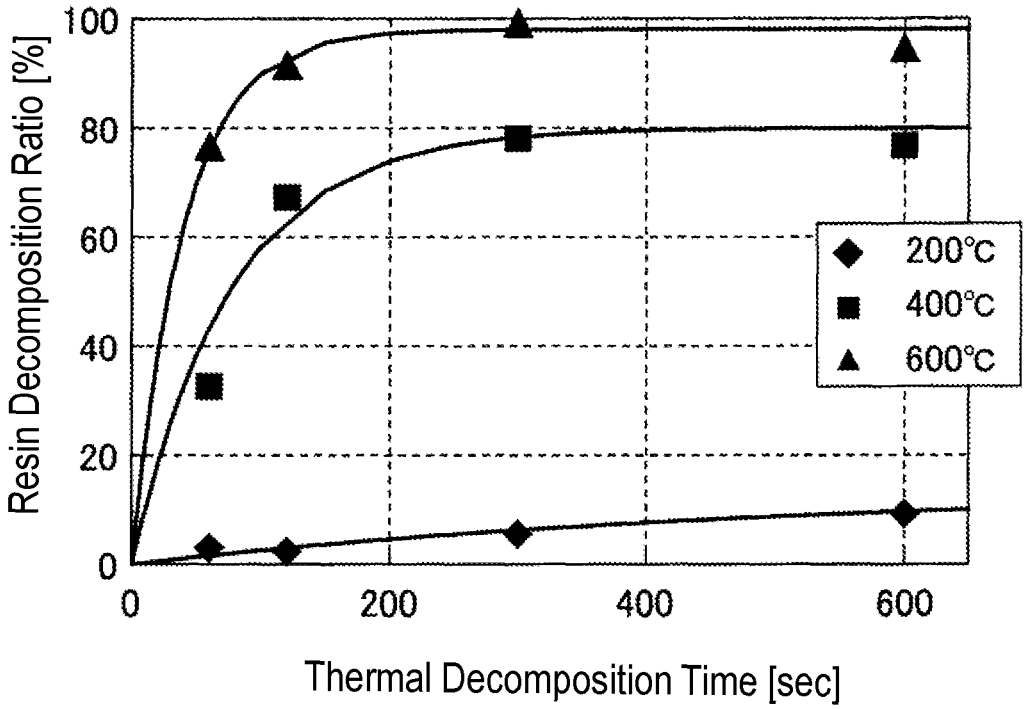
FIG. 5 is a graph showing the relationship between a resin decomposition ratio and a thermal deposition time in a mold wash D.

A heat exposure test was performed on the four kinds of mold washes shown in Table 1. The heat exposure test was performed by holding the mold wash in the environment of a retention temperature (200° C., 400° C., and 600° C.) for a predetermined time (1 minute, 2 minutes, 5 minutes, and 10 minutes), followed by air cooling. A weight of the sample of the mold wash before and after the test was measured, and a decomposition ratio of the resin binder (resin decomposition ratio) [%] due to thermal decomposition was evaluated. The relationship between the resin decomposition ratio and the thermal decomposition time in the mold wash A is shown in FIG. 2. The relationship between the resin decomposition ratio and the thermal decomposition time in the mold wash B is shown in FIG. 3. The relationship between the resin decomposition ratio and the thermal decomposition time in the mold wash C is shown in FIG. 4. The relationship between the resin decomposition ratio and the thermal decomposition time in the mold wash D is shown in FIG. 5. In FIG. 2 to FIG. 5, the plots are concerned with the experiment results, and the solid lines are concerned with the results estimated from the formula (1).

Figure 6:
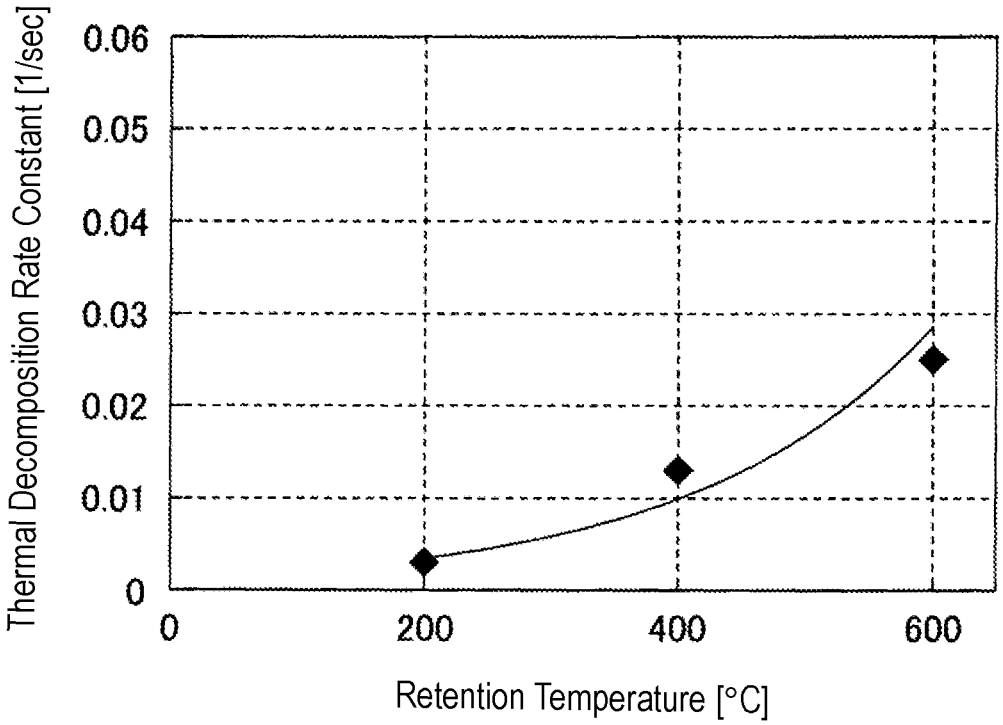
FIG. 6 is a graph showing the relationship between a thermal decomposition rate constant and a retention temperature in a mold wash A.
Figure 7:
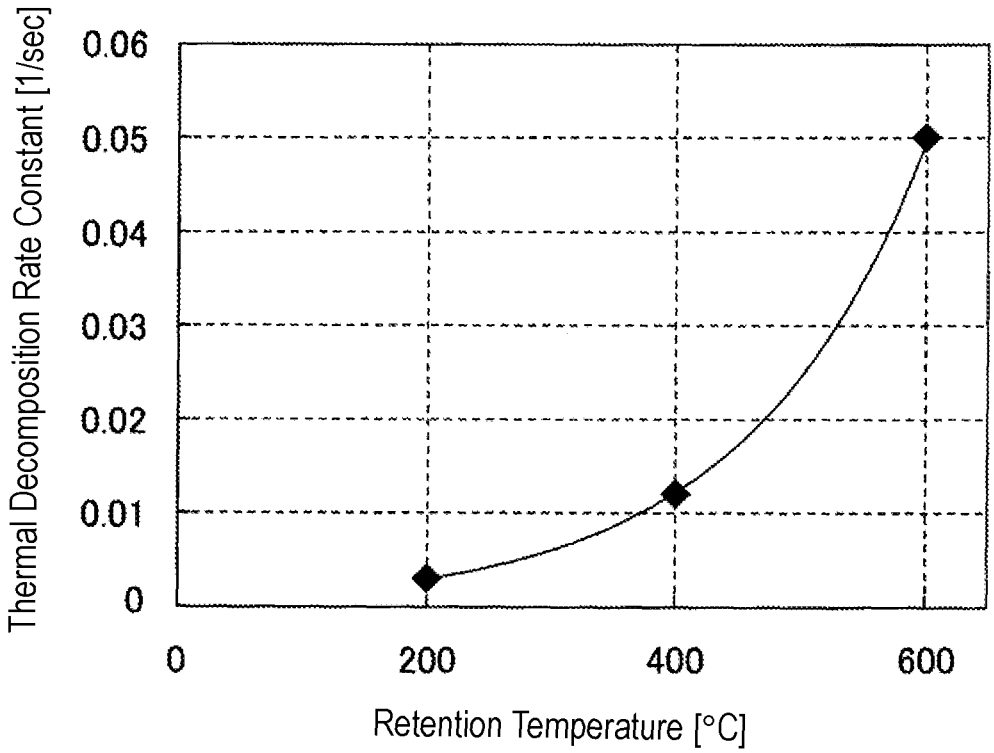
FIG. 7 is a graph showing the relationship between a thermal decomposition rate constant and a retention temperature in a mold wash B.
Figure 8:
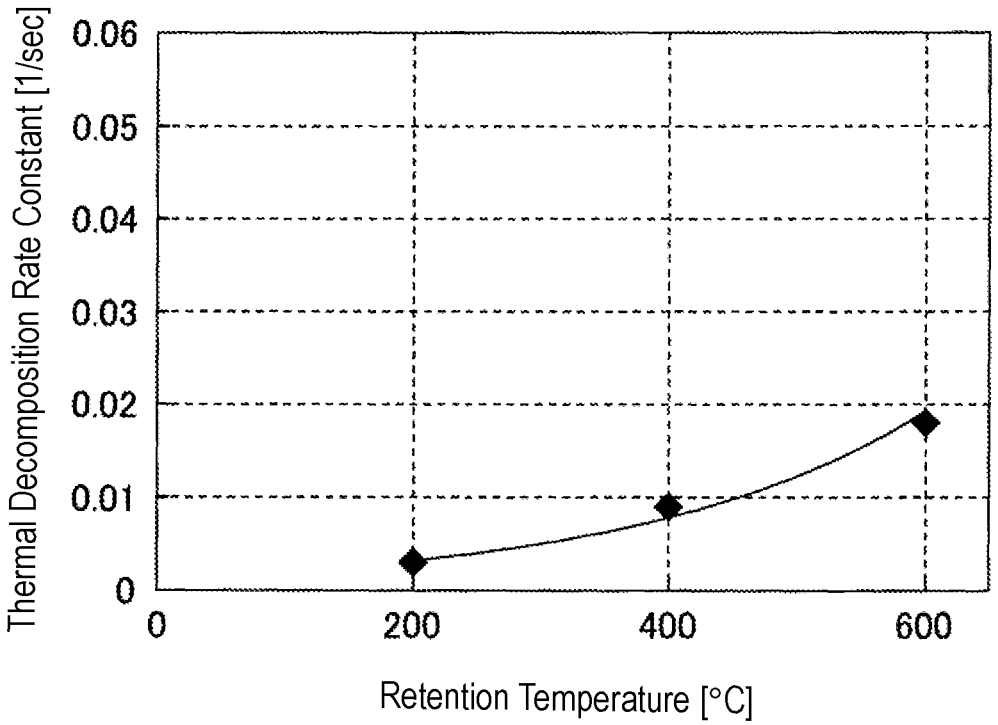
FIG. 8 is a graph showing the relationship between a thermal decomposition rate constant and a retention temperature in a mold wash C.
Figure 9:
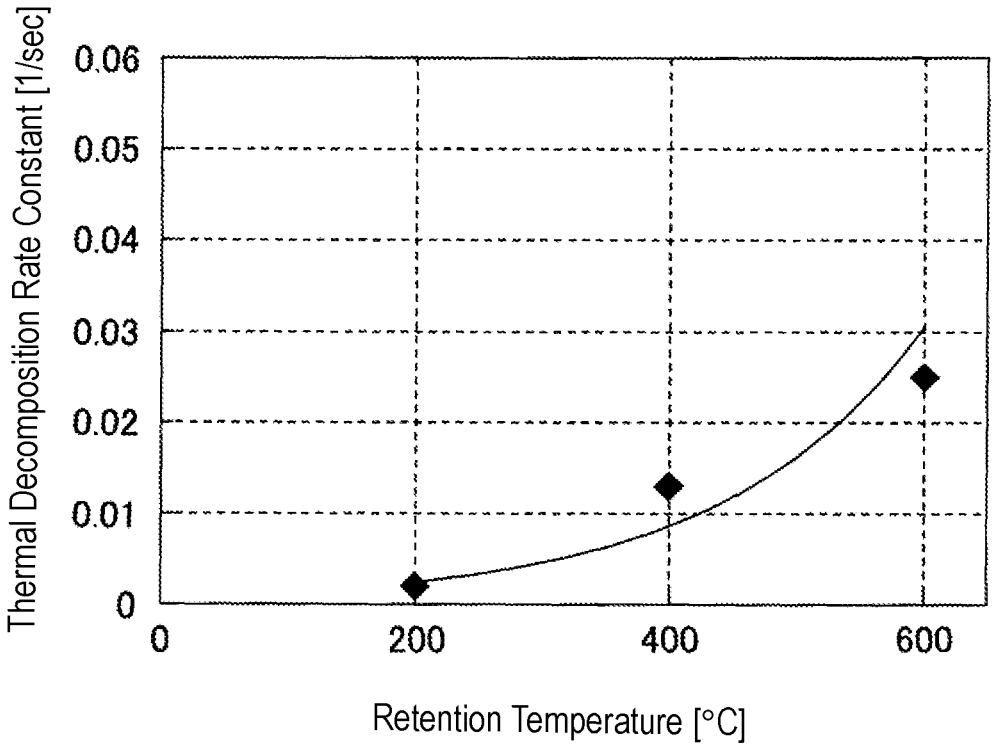
FIG. 9 is a graph showing the relationship between a thermal decomposition rate constant and a retention temperature in a mold wash D.

A thermal decomposition rate constant $k_d$ was identified from the experiment results. The relationship between the thermal decomposition rate constant $k_d$ and the retention temperature in the mold wash A is shown in FIG. 6. The relationship between the thermal decomposition rate constant $k_d$ and the retention temperature in the mold wash B is shown in FIG. 7. The relationship between the thermal decomposition rate constant $k_d$ and the retention temperature in the mold wash C is shown in FIG. 8. The relationship between the thermal decomposition rate constant $k_d$ and the retention temperature in the mold wash D is shown in FIG. 9. In FIG. 6 to FIG. 9, the plots are concerned with the values identified from the experiment results, and the solid lines are concerned with the estimation results after performing fitting using the formula (3).

Figure 10:
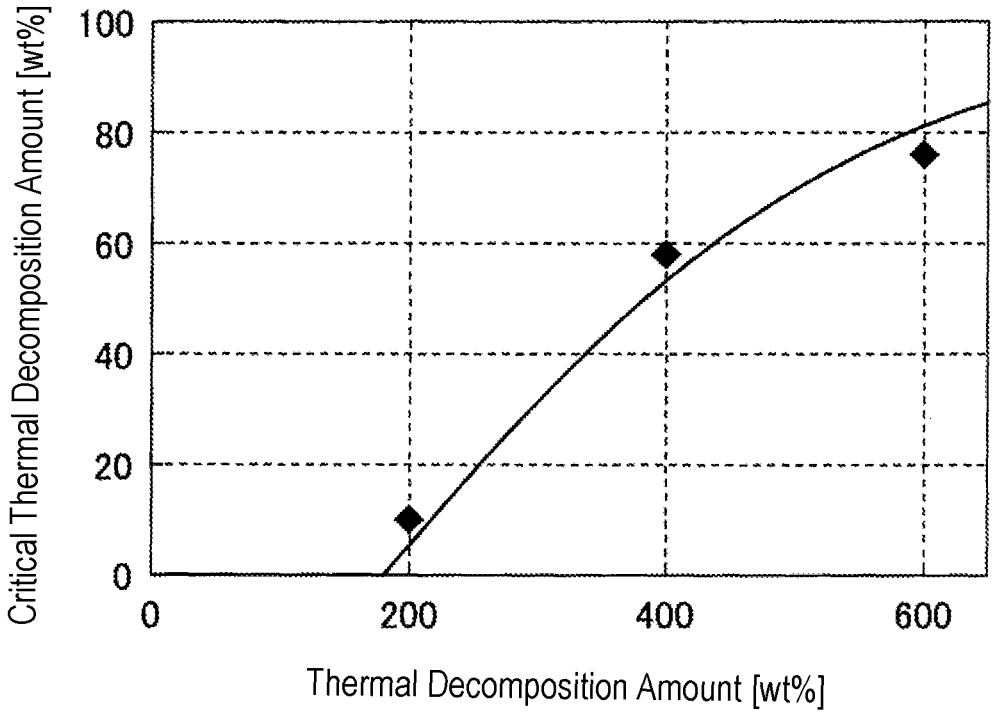
FIG. 10 is a graph showing the relationship between a critical thermal decomposition amount and a retention temperature in a mold wash A.
Figure 11:
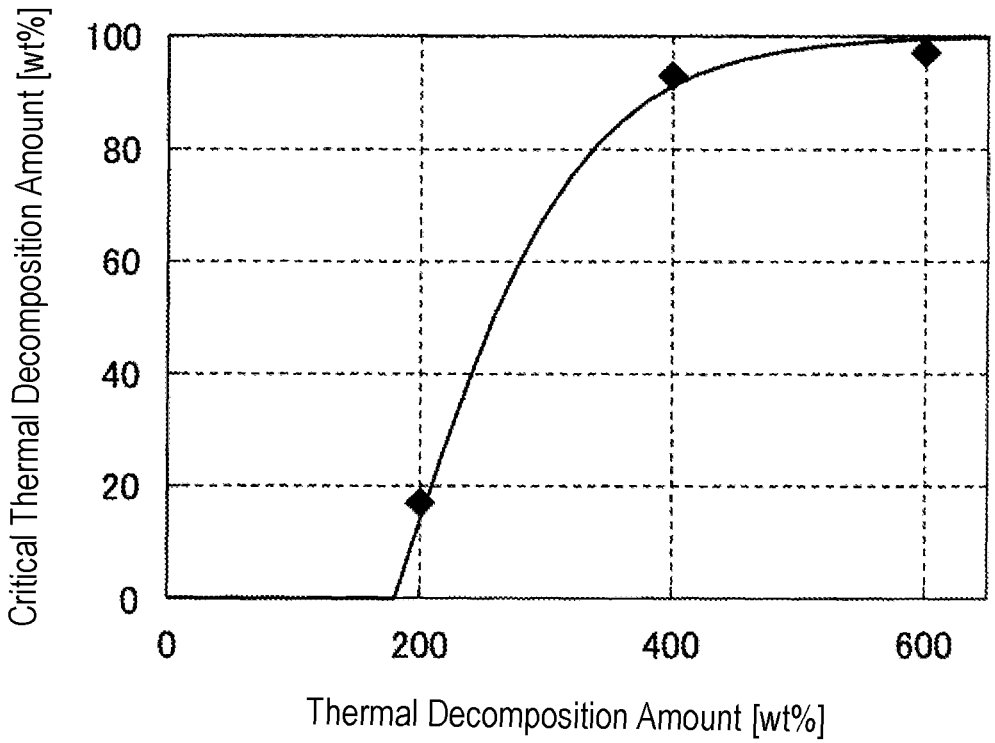
FIG. 11 is a graph showing the relationship between a critical thermal decomposition amount and a retention temperature in a mold wash B.
Figure 12:
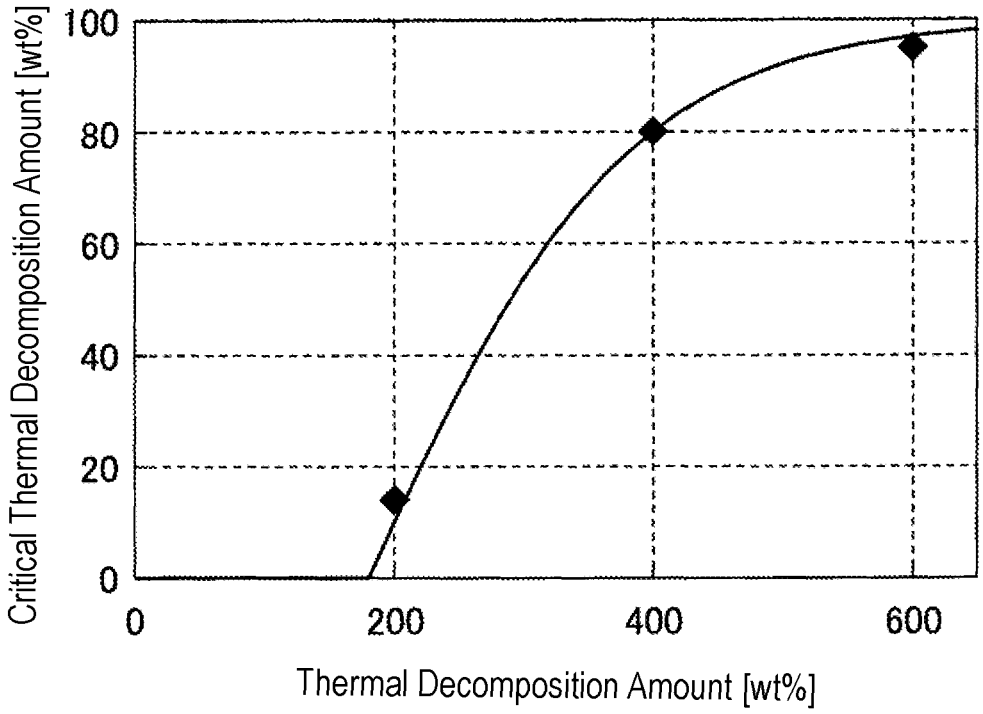
FIG. 12 is a graph showing the relationship between a critical thermal decomposition amount and a retention temperature in a mold wash C.
Figure 13:
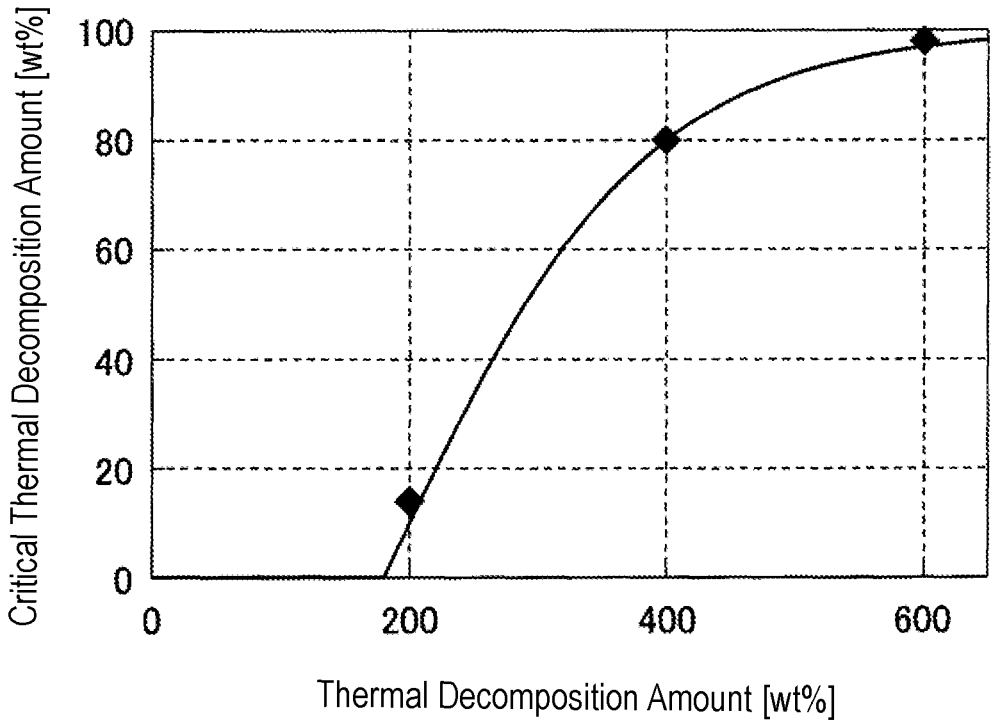
FIG. 13 is a graph showing the relationship between a critical thermal decomposition amount and a retention temperature in a mold wash D.

Furthermore, the critical thermal decomposition amount $\Delta C_{sat}(\theta)$ of the resin binder was identified from the experiment results. The relationship between the critical thermal decomposition amount $\Delta C_{sat}(\theta)$ and the retention temperature in the mold wash A is shown in FIG. 10. The relationship between the critical thermal decomposition amount $\Delta C_{sat}(\theta)$ and the retention temperature in the mold wash B is shown in FIG. 11. The relationship between the critical thermal decomposition amount $\Delta C_{sat}(\theta)$ and the retention temperature in the mold wash C is shown in FIG. 12. The relationship between the critical thermal decomposition amount $\Delta C_{sat}(\theta)$ and the retention temperature in the mold wash D is shown in FIG. 13. In FIG. 10 to FIG. 13, the plots are concerned with the values identified from the experiment results. In general, it is known that the thermal decomposition of the resin binders which are used for a mold wash start at around 200° C. Then, in all of the mold washes objective to the examination, the fitting was performed according to the formula (2) while setting the temperature $\theta_s$ at which the thermal decomposition starts to 180° C. In FIG. 10 to FIG. 13, the solid lines are concerned with the estimation results after performing the fitting.

The fitting results of the material parameters A, α, and β relative to the various mold washes are those in Table 2.

TABLE 2

| Mold wash | A | α | β |
|---|---|---|---|
| A | $1.2 \times 10^{-3}$ | $5.3 \times 10^{-3}$ | $2.7 \times 10^{-3}$ |
| B | $7.0 \times 10^{-4}$ | $7.0 \times 10^{-3}$ | $7.0 \times 10^{-3}$ |
| C | $1.3 \times 10^{-3}$ | $4.5 \times 10^{-3}$ | $5.0 \times 10^{-4}$ |
| D | $7.0 \times 10^{-4}$ | $6.5 \times 10^{-4}$ | $5.0 \times 10^{-4}$ |

From the foregoing results, it has been confirmed that even in the mold washes of a different kind from each other, the thermal decomposition amount and thermal decomposition rate of the resin binder contained in the mold wash can be estimated by adopting the formulae (1) to (3).

(Estimation of Change in Strength of Mold Sash Due to Thermal Decomposition)

The strength of the mold wash was evaluated in terms of a transvers rupture strength (bending strength) as described above. However, it is extremely difficult to directly measure the high-temperature strength of the mold wash. Then, samples of the various mold washes were each subjected to a heat treatment while making the retention temperature and thermal decomposition time different from each other, to thermally decompose the resin binder, and the temperature was then returned to room temperature, thereby calculating the thermal decomposition amount $\Delta C(\theta,t)$ of the resin binder from a change in weight of the sample before and after the heat treatment, and measuring the room temperature transverse rupture strength $\sigma_b(\theta,t)$ according to a bending test at room temperature.

Figure 14:
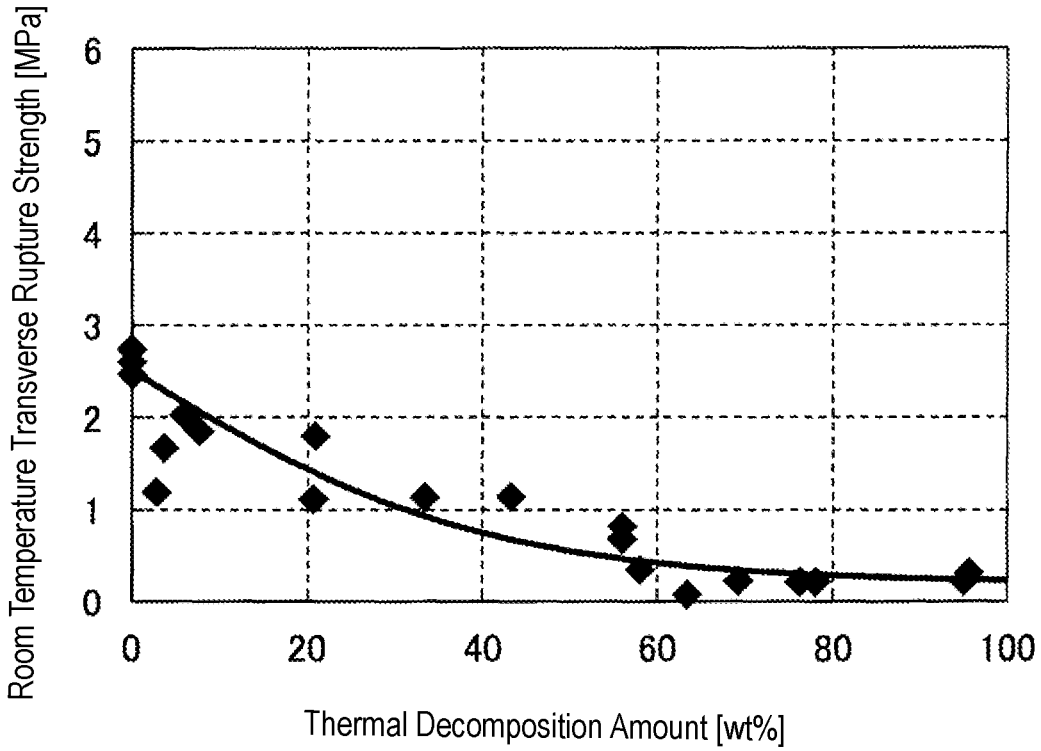
FIG. 14 is a graph showing the relationship between a room temperature transverse rupture strength and a thermal decomposition amount of resin binder in a mold wash A after receiving thermal loads.
Figure 15:
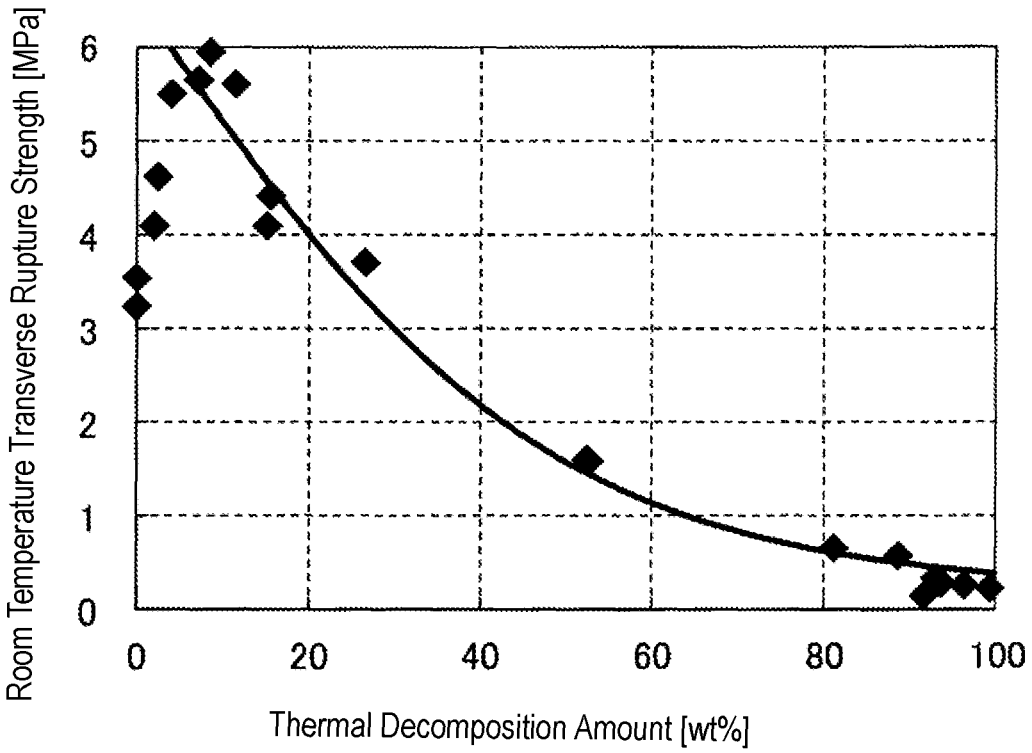
FIG. 15 is a graph showing the relationship between a room temperature transverse rupture strength and a thermal decomposition amount of resin binder in a mold wash B after receiving thermal loads.
Figure 16:
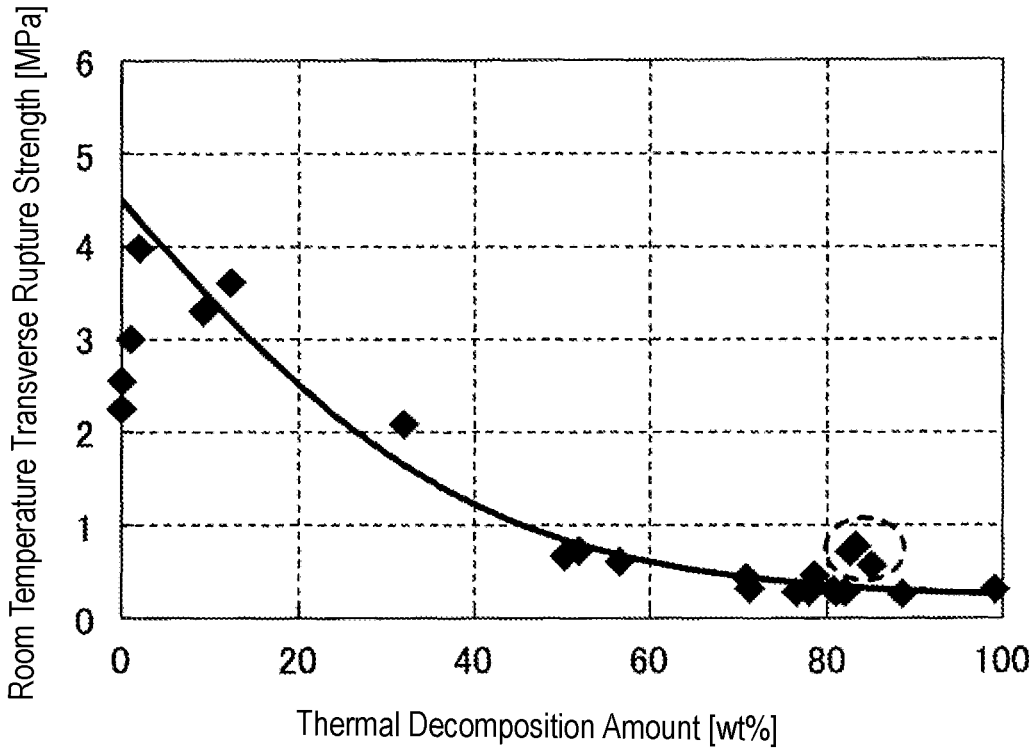
FIG. 16 is a graph showing the relationship between a room temperature transverse rupture strength and a thermal decomposition amount of resin binder in a mold wash C after receiving thermal loads.
Figure 17:
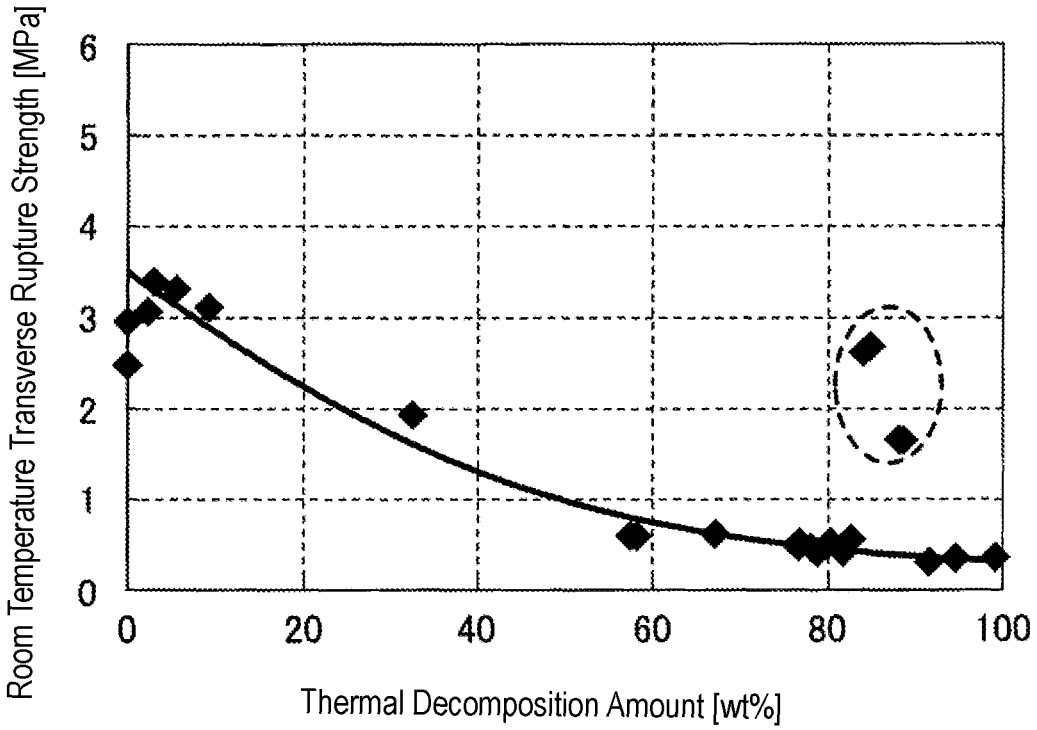
FIG. 17 is a graph showing the relationship between a room temperature transverse rupture strength and a thermal decomposition amount of resin binder in a mold wash D after receiving thermal loads.

The relationship between the room temperature transverse rupture strength $\sigma_b(\theta,t)$ and the thermal decomposition amount $\Delta C(\theta,t)$ of the resin binder in the mold wash A after receiving thermal loads is shown in FIG. 14. The relationship between the room temperature transverse rupture strength $\sigma_b(\theta,t)$ and the thermal decomposition amount $\Delta C(\theta,t)$ of the resin binder in the mold wash B after receiving thermal loads is shown in FIG. 15. The relationship between the room temperature transverse rupture strength $\sigma_b(\theta,t)$ and the thermal decomposition amount $\Delta C(\theta,t)$ of the resin binder in the mold wash C after receiving thermal loads is shown in FIG. 16. The relationship between the room temperature transverse rupture strength $\sigma_b(\theta,t)$ and the thermal decomposition amount $\Delta C(\theta,t)$ of the resin binder in the mold wash D after receiving thermal loads is shown in FIG. 17. In FIG. 14 to FIG. 17, the plots are concerned with the experiment results, and the solid lines are concerned with the estimation results based on the formula (4).

Here, with respect to the mold washes C and D, the plots which slightly come out from the estimation results (plots surrounded by the broken lines) are included. These are ones in which the room temperature transverse rupture strength $\sigma_b(\theta,t)$ shifts towards the high-strength side because a new product was formed by the reaction and sintering among the aggregates. That is, this is caused by the strength increase $\sigma_s(\theta,t)$ caused by reaction and sintering among the aggregates. In the mold washes C and D, silica and alumina are contained in the aggregate components as shown in Table 1, and it has been confirmed that these caused high-temperature reaction and sintering, whereby the amount of mullite (compound of silica and alumina) increased.

On the occasion of identifying the material parameters based on the formula (4), it is necessary to pay attention to the strength decrease caused by the thermal decomposition of the resin binder. For that reason, after eliminating the data regarding the increase of strength due to the reaction and sintering among the aggregates, $\sigma_{c0}$, $\sigma_{c1}$, and $\gamma$ based on the formula (4), the values of which are changed depending upon the material of the mold wash, were identified. The results are shown in Table 3.

TABLE 3

| Mold wash | $\sigma_{c0}$ [MPa] | $\sigma_{c1}$ [MPa] | $\gamma$ |
|---|---|---|---|
| A | 2.5 | 0.2 | $2.5 \times 10^{-2}$ |
| B | 6.5 | 0.2 | $2.1 \times 10^{-2}$ |
| C | 4.5 | 0.2 | $2.5 \times 10^{-2}$ |
| D | 3.5 | 0.2 | $2.0 \times 10^{-2}$ |

From the foregoing results, it has been confirmed that even in the mold washes of a different kind from each other, the change of the room temperature transverse rupture strength $\sigma_b(\theta,t)$ relying upon the thermal decomposition amount $\Delta C(\theta,t)$ of the resin binder can be estimated based on the formula (4).

(Casting Experiment)

A casting including a small hole was made by using the casting pattern 1 provided with the hole 3 with a length of 100 mm and a diameter of 8 to 14 mm extending from the upper surface to the lower surface in the foam pattern 2 having a rectangular parallelepiped shape of 25×100×200 [mm] as shown in FIG. 1A and FIG. 1B. Gray cast iron (JIS-FC250) was used as the molten metal, and four kinds of the mold washes A to D shown in Table 1 were used as the mold wash. The mold wash was twice applied to the casting pattern 1 (dual coating), and silica sand was used as the foundry sand. The results as to whether or not a hole can be formed by casting shown in Table 4.

TABLE 4

| | Diameter of hole [mm] | | | |
|---|---|---|---|---|
| Mold wash | 8 | 10 | 12 | 14 |
| A | No | No | No | Yes |
| B | Yes | Yes | Yes | Yes |
| C | Yes | Yes | Yes | Yes |
| D | Yes | Yes | Yes | Yes |

With respect to the mold wash A, a small hole with a minimum diameter of 14 mm could be formed by casting, and with respect to the mold washes B to D, a small hole with a minimum diameter of 8 mm could be formed by casting, respectively.

Here, as a selection method of a mold wash suitable for forming a small hole by casting, an appropriate range of the room temperature transverse rupture strength $\sigma_b(\theta,t)$ of the mold wash having received thermal loads and a threshold value thereof were investigated.

With respect to the mold wash A, though it is found from FIG. 2, FIG. 6, and FIG. 10 that the progress of the thermal decomposition of the resin binder tends to be slow as compared with the other mold washes, it is found from FIG. 14 that the room temperature transverse rupture strength $\sigma_b(\theta,t)$ after the thermal decomposition has proceeded is low as compared with the other mold washes. For this reason, it may be conjectured that as for the mold wash A, it was difficult to form a hole having a diameter of 12 mm or less by casting.

With respect to the mold wash B, though it is found from FIG. 3, FIG. 7, and FIG. 11 that the progress of the thermal decomposition of the resin binder is fast as compared with the other mold washes, it can be confirmed from FIG. 15 that even when the thermal decomposition proceeds, the room temperature transverse rupture strength $\sigma_b(\theta,t)$ tends to be high. For this reason, it may be considered that as for the mold wash B, forming of a small hole with a diameter to an extent of 8 mm by casting could be realized.

On the other hand, with respect to the mold washes C and D, from FIG. 4 and FIG. 5, FIG. 8 and FIG. 9, and FIG. 12 and FIG. 13, the behavior of the thermal decomposition of the resin binder and the behavior of lowering of the room temperature transverse rupture strength $\sigma_b(\theta,t)$ caused by the progress of the thermal decomposition is positioned between the mold wash A and the mold wash B. From FIG. 16 and FIG. 17, it may be considered that in view of the fact that the reaction and sintering (mullite formation) among the aggregates proceeded due to an influence of the heat received during casting, the strength of the mold wash itself increased, so that forming of a small hole with a diameter to an extent of 8 mm by casting could be realized.

With respect to the mold washes C and D, it may be conjectured from FIG. 14 to FIG. 17 that so long as the heat such that the thermal decomposition amount $\Delta C(\theta,t)$ of the resin binder becomes 83 wt % or more is not given, the strength increase caused by reaction and sintering among the aggregates is not revealed. In general, it is known that a temperature at which the mullite formation reaction starts is around 1,000° C. depending upon the material composition, and the molten metal temperature of gray cast iron is about 1,400° C. From these, it is reasonable to consider that almost all of the resin binder of the mold wash exposed to the molten metal was thermally decomposed, and the reaction and sintering among the aggregates took place.

Figure 18:
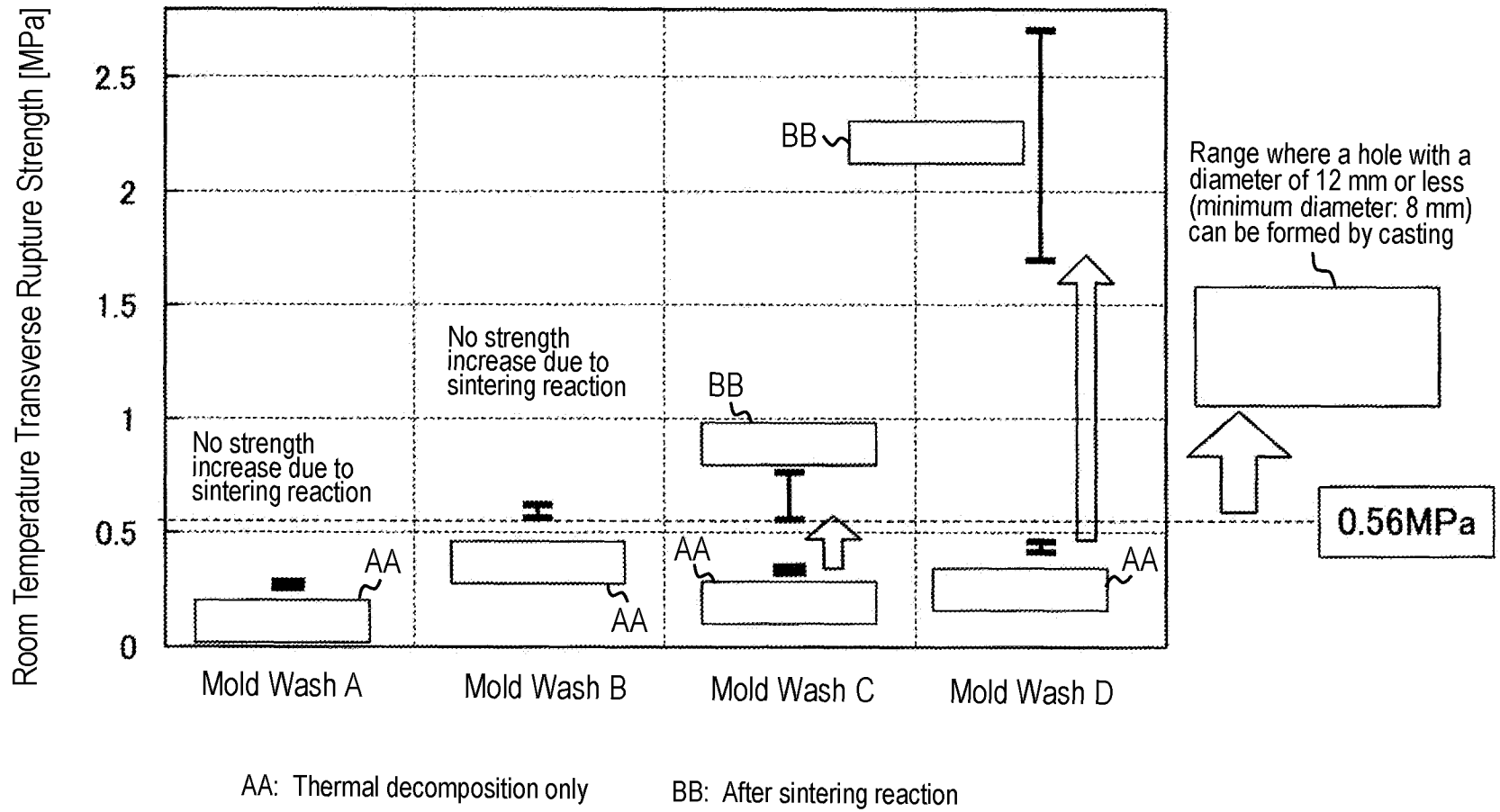
FIG. 18 is a diagram in which a room temperature transverse rupture strength and the results as to whether or not a hole could be formed by casting for each mold wash in a range of a thermal decomposition amount of resin binder of from 80 to 84 wt % or after sintering reaction, are arranged in order.

Then, a diagram in which by adopting the formula (4), the room temperature transverse rupture strength $\sigma_b(\theta,t)$ and the results as to whether or not a hole could be formed by casting for each mold wash in a range of the thermal decomposition amount $\Delta C(\theta,t)$ of the resin binder of from 80 to 84 wt % or after sintering reaction, are arranged in order is illustrated in FIG. 18. The range where the thermal decomposition amount of the resin binder is from 80 to 84 wt % is a range where an increase of the room temperature transverse rupture strength $\sigma_b(\theta,t)$ caused by the reaction and sintering among the aggregates is largest. From these results, it can be judged that even when the thermal decomposition amount $\Delta C(\theta,t)$ of the resin binder proceeds to an extent of 83 wt % or more, so long as the room temperature transverse rupture strength $\sigma_b(\theta,t)$ of the mold wash taking into consideration the room temperature transverse rupture strength $\sigma_{c1}$ remaining in the mold wash, or the strength increase $\sigma_s(\theta,t)$ caused by the reaction and sintering among the aggregates, is 0.56 MPa or more, it is possible to form a small hole with a diameter of 8 mm or more and 12 mm or less and a length of 100 mm or less by casting in the casting with a thickness of 25 mm or less.

In the light of the above, so long as the thermal decomposition behavior of the resin binder of various mold washes and the properties of the room temperature transverse rupture strength $\sigma_b(\theta,t)$ after receiving thermal loads can be grasped, it becomes possible to select the mold wash suitable for forming a small hole by casting. Data regarding the properties of the above-described mold washes can be acquired through relatively simple experiments such as the above-described heat exposure test and room temperature transverse rupture strength test.

EFFECTS

As described above, in accordance with the casting method using a lost foam in the present embodiment, on the occasion of making a casting with a thickness T [mm], the casting including a hole with a diameter of 12 mm or less and a length l [mm], the thermal decomposition amount and thermal decomposition rate of the resin binder contained in the mold wash can be estimated by adopting the formulae (1) to (3). A change of the room temperature transverse rupture strength $\sigma_b(\theta,t)$ relying on the thermal decomposition amount $\Delta C(\theta,t)$ of the resin binder can be estimated by adopting the formula (4). From these estimation results, a mold wash which is less in a lowering of the strength to be caused by the thermal loads and which is suitable for forming a small hole by casting can be selected. Specifically, the thermal decomposition amount $\Delta C(\theta,t)$ [wt %] of the resin binder when the mold wash is exposed at the temperature θ [° C.] for the time t [sec] is determined based on the formulae (1) to (3). Then, the determined thermal decomposition amount $\Delta C(\theta,t)$ is substituted into the formula (4), thereby determining the room temperature transverse rupture strength $\sigma_b(\theta,t)$ [MPa] of the mold wash after receiving the thermal loads. Then, the casting is performed with the mold wash having the determined room temperature transverse rupture strength $\sigma_b(\theta,t)$ being equal to or larger than the threshold value $\sigma_{cr}$ [MPa]. Thanks to this, since the strength of the mold wash can be made to exceed the external forces from the molten metal, the mold wash can be prevented from being damaged. Accordingly, even a highly-finished small hole with a diameter of 12 mm or less can be formed by casting.

By performing the casting with the mold wash having the room temperature transverse rupture strength $\sigma_b(\theta,t)$ after receiving thermal loads being 0.56 MPa or more, the strength of the mold wash can be suitably made to exceed the external forces from the molten metal.

When the thermal decomposition amount $\ominus C(\theta,t)$ of the resin binder is 83 wt % or more, a strength increase caused by reaction and sintering among the aggregates is revealed. At this time, by performing the casting with the mold wash having the room temperature transverse rupture strength $\sigma_b(\theta,t)$ after receiving thermal loads being 0.56 MPa or more, the strength of the mold wash can be suitably made to exceed the external forces from the molten metal.

On the occasion of making a casting with a thickness T of 25 mm or less, the casting including a hole with a diameter of 8 mm or more and a length l of 100 mm or less, the mold wash is twice applied to the foam pattern. Thanks to this, the thickness of the mold wash can be made uniform, and therefore, the mold wash can be made to be hardly damaged.

While the embodiment of the present invention has been described above, this description is merely illustrative of the exemplary embodiment and is not particularly intended to limit the present invention. Such a specific configuration and so on may be suitably varied in design. The actions and effects disclosed in the embodiment of the invention merely exemplify the most preferable acts and effects resulting from the present invention, and it should be construed that the acts and effects according to the present invention are not limited to those disclosed in the embodiment of the present invention.

The present application is based on Japanese patent application No. 2016-017657 filed on Feb. 2, 2016 and Japanese patent application No. 2016-058743 filed on Mar. 23, 2016, the entire subject matters of which are incorporated herein by reference.

INDUSTRIAL APPLICABILITY

The present invention is concerned with a casting method using a lost foam and is useful for the case of forming a small hole with a diameter of 12 mm or less by casting.

REFERENCE SINGS LIST

1: Casting pattern
2: Foam pattern
3: Hole
3*a*: Hole end

The invention claimed is:

1. A casting method using a lost foam, comprising embedding, in foundry sand, a casting pattern formed by applying a mold wash to a surface of a foam pattern; and pouring a molten metal into the casting pattern and losing the foam pattern to replace the foam pattern with the molten metal, thereby making a casting with a thickness T [mm], the casting including a hole with a diameter of 12 mm or less and a length l [mm], the casting method comprising the steps of:

determining a thermal decomposition amount $\Delta C(\theta,t)$ [wt %] of a resin binder when the mold wash is exposed at a temperature θ [° C.] for a time t [sec], from the following formulae (1) to (3), wherein $\Delta C_{sat}(\theta)$ [wt %] is a critical thermal decomposition amount of the resin binder contained in the mold wash at a temperature θ [° C.], $k_d$ [1/sec] is a thermal decomposition rate constant of the resin binder, $\theta_s$ [° C.] is a temperature at which thermal decomposition of the resin binder starts, and A, α, and τ3 are material parameters relying on a material of the mold wash, respectively;

determining a room temperature transverse rupture strength $\sigma_b(\theta,t)$ [MPa] of the mold wash after receiving thermal loads from the following formula (4), wherein $\sigma_{c0}$ [MPa] is a room temperature transverse rupture strength of the mold wash before receiving thermal loads, $\sigma_{c1}$ [MPa] is a room temperature transverse rupture strength of the mold wash after the resin binder is completely thermally decomposed, $\sigma_s(\theta,t)$ [MPa] is a strength increase caused by reaction and sintering among aggregates contained in the mold wash, and γ is a material parameter relying on the material of the mold wash; and performing casting with the mold wash having the room temperature transverse rupture strength $\sigma_b(\theta,t)$ after receiving thermal loads being equal to or larger than a threshold value $\sigma_{cr}$ [MPa]:

$$\Delta C(\theta,t)=\Delta C_{sat}(\theta)\cdot\{1-\exp(-k_d t)\} \quad (1)$$

$$\Delta C_{sat}(\theta)=\tanh\{\beta(\theta-\theta_s)\}\times 100 \quad (2)$$

$$k_d = A\exp(\alpha\theta) \quad (3)$$

$$\sigma_b(\theta,t) = \sigma_{c0} - (\sigma_{c0} - \sigma_{c1})\tanh(\gamma\Delta C(\theta,t)) + \sigma_s(\theta,t) \quad (4).$$

2. The casting method using a lost foam according to claim 1, wherein the threshold value $\sigma_{cr}$ is 0.56 MPa.

3. The casting method using a lost foam according to claim 2, wherein the mold wash is twice applied to the foam pattern for making a casting with a thickness T of 25 mm or less, the casting including a hole with a diameter of 8 mm or more and a length l of 100 mm or less.

4. The casting method using a lost foam according to claim 1, wherein when the thermal decomposition amount $\Delta C(\theta,t)$ of the resin binder is 83 wt % or more, the threshold value $\sigma_{cr}$ is 0.56 MPa.

5. The casting method using a lost foam according to claim 4, wherein the mold wash is twice applied to the foam pattern for making a casting with a thickness T of 25 mm or less, the casting including a hole with a diameter of 8 mm or more and a length l of 100 mm or less.

6. The casting method using a lost foam according to claim 1, wherein the mold wash is twice applied to the foam pattern for making a casting with a thickness T of 25 mm or less, the casting including a hole with a diameter of 8 mm or more and a length l of 100 mm or less.

* * * * *